US007841738B2

(12) United States Patent
Engel

(10) Patent No.: US 7,841,738 B2
(45) Date of Patent: Nov. 30, 2010

(54) LUMINAIRE HAVING LIGHT EMITTING DIODES (LEDS) DIRECTED TO A REFLECTOR

(76) Inventor: Hartmut S. Engel, Monrepos Strasse 7, Ludwigsburg (DE) 71634

( * ) Notice: Subject to any disclaimer, the term of this patent is extended or adjusted under 35 U.S.C. 154(b) by 236 days.

(21) Appl. No.: 12/184,533

(22) Filed: Aug. 1, 2008

(65) Prior Publication Data

US 2009/0034252 A1 Feb. 5, 2009

(30) Foreign Application Priority Data

Aug. 2, 2007 (EP) ..... 07015210

(51) Int. Cl.
*F21S 8/02* (2006.01)

(52) U.S. Cl. ..... 362/235; 362/249.02; 362/249.03; 362/249.04; 362/249.05; 362/249.06

(58) Field of Classification Search ..... 362/235, 362/240, 249.02, 249.03, 249.04, 249.05, 362/249.06, 298, 300, 800
See application file for complete search history.

(56) References Cited

U.S. PATENT DOCUMENTS 3,536,905 A * 10/1970 Ruff et al. ..... 362/1
5,136,483 A * 8/1992 Schoniger et al. ..... 362/545
5,265,357 A * 11/1993 Yu ..... 40/714
5,285,356 A * 2/1994 Skene et al. ..... 362/1
6,238,073 B1 * 5/2001 Ito et al. ..... 362/544
6,840,652 B1 1/2005 Hymer
6,871,993 B2 * 3/2005 Hecht ..... 362/555
7,441,930 B2 * 10/2008 Lin ..... 362/410
7,520,636 B2 * 4/2009 Van Der Poel ..... 362/290
7,530,712 B2 * 5/2009 Lin et al. ..... 362/247
7,559,664 B1 * 7/2009 Walleman et al. ..... 362/84
2005/0219860 A1 10/2005 Schexnaider

FOREIGN PATENT DOCUMENTS

WO WO 2007/054889 A 5/2007

* cited by examiner

*Primary Examiner*—Sharon E Payne
(74) *Attorney, Agent, or Firm*—Townsend and Townsend and Crew, LLP

(57) ABSTRACT

A luminaire is described having a pot-shaped housing for the reception of electrical components and for the releasable mounting of a functional unit having at least one main lighting surface and whose special features consist of the facts that the preferably planar main lighting surface of the functional unit extends parallel to the base wall of the housing or its mounting surface and is bounded at the marginal side by a peripheral flat frame made of heat conducting material; and that the flat frame is connected in a heat conducting manner to at least one LED carrier which is located in the functional unit in the region of the rear side of the flat frame and its surface carrying the LEDs is directed to a reflector arranged between the base wall of the housing and the main lighting surface such that the main lighting surface is illuminated substantially uniformly by diffuse light.

20 Claims, 4 Drawing Sheets

LUMINAIRE HAVING LIGHT EMITTING DIODES (LEDS) DIRECTED TO A REFLECTOR

CROSS-REFERENCE TO RELATED APPLICATIONS

This application claims priority to European Application No. 07 015 210.3, filed Aug. 2, 2007, the disclosure of which is herein incorporated by reference.

BACKGROUND OF THE INVENTION

The invention relates to luminaires.

A luminaire is disclosed in the document WO 2007/054889 A with a pot-shaped housing for the reception of electrical components and for the releasable mounting of a functional unit having a main lighting surface, wherein the main lighting surface of the functional unit extends parallel to the base wall of the housing and LEDs located in the functional unit are directed to a reflector arranged between the base wall of the housing and the main lighting surface such that the main lighting surface has diffuse light applied to it.

A luminaire is known from U.S. Pat. No. 6,840,652 B1 in which LEDs arranged at the rim side are directed toward a reflector arranged at the base of the housing via which a main lighting surface has reflection light applied to it.

A light fixture panel is known from US 2005/0219860 A1 which consists of a closed sectional frame, wherein a surface surrounded by this frame is made as a reflective surface and the oppositely disposed surface surrounded by the frame is made as a light permeable surface. LEDs which apply light to the reflective surface and to the light permeable surface are provided in corresponding recesses of the frame in the central region between these two surfaces.

SUMMARY OF THE INVENTION

It is an object of the present invention to develop a luminaire of the initially named kind such that it can be used both for the indoor area and for the outdoor area, such that it can be designed as a pure LED luminaire with an areal light output and such that it ensures a best possible heat dissipation.

A luminaire is obtained by these measures having the character of a flat screen in an esthetic respect and with a main lighting surface having diffuse light applied uniformly via the reflector and accordingly not disposed in the direct light region, and having a main lighting surface backlit uniformly and diffusely which has a monochromatic light color in dependence on the respectively used LED illuminant, but also being able to output dynamic RGB light.

In this respect, it is of particular advantage that the peripheral flat frame made of heat conducting material is used as a cooling surface and directs the heat generated within the luminaire outwardly in an efficient manner.

The flat frame preferably forms both the outer boundary of the main lighting surface at the edge side at the visible side and of the functional unit, whereby the light contrast is increased and the luminaire appears with sharply draw contours so that the impression of a framed lighting surface arises in an esthetic respect.

The functional unit supporting the flat frame is designed as a light permeable member, in particular as an opal glass member, or as a single-part or multi-part light permeable plastic member into which the flat frame is inserted in an areally flush manner and is connected via heat conducting elements passing through the wall of the functional unit to the LED carriers likewise made in a heat conducting manner.

It is possible by the design of the functional unit in the form of a light permeable member to provide, in addition to the main lighting surface, side lighting surfaces, which have light applied via the reflector and/or also directly, between the flat frame and the housing, with partial reflector surfaces also being able to be associated with the side lighting surfaces and being formed by angled marginal regions of the concavely curved reflector to which LED light is applied over the full surface.

A polygonal, in particular rectangular, a square or a round light member can be provided by this embodiment which has clearly bounded diffuse lighting surfaces, with the actual light sources not being visible, but being arranged in a completely covered manner.

A particularly advantageous embodiment of the invention which likewise has the advantages already explained above is characterized in that the functional unit is made as a frame body expanding at all sides starting from the flat pot-shaped housing and has a base section couplable to the housing and an expanding slanted surface section adjoining it which merges into a marginal section which is made as a carrier for the main lighting surface and the flat frame.

In particular when the angle between the base wall of the housing and the slanted surface sections is selected to be much lower than 45°, the desired character of a flat screen results in this manner for the luminaire in an esthetic respect.

In accordance with a further embodiment variant of the invention, to increase the light yield in comparison with a functional unit made, for example, of opal glass or of a corresponding plastic material, a plastic plate provided with a microprism structure is used for the main lighting surface which is preferably covered with a glass plate at the prism side and with a light scattering foil at the rear side. The plate-shaped main lighting surface can be combined with the flat frame to form a unit and can be connected, in particular welded or adhesively bonded, to the end region of the functional unit via a peripheral rim angled at a right angle.

With the embodiment variant of the invention with a flat screen shape, a reflector forming a dividing wall and preferably of planar type is arranged between the base section and the slanted surface section. The walls of the slanted surface sections can be made as light permeable; however, it is also possible to design the inner walls of the slanted surface sections as reflective.

To ensure a visually practically not visible power supply of the LED units despite the reflector surface which forms a dividing wall, provision is made in this embodiment for the required conducting wires to extend in the folding edges between adjacent slanted wall part areas. To ensure a problem-free installation, these conducting wires are connected to the LED groups in each case via a spring contact engaging at a contact surface at the LED carrier such that the electrical contacts are necessarily established when the unit of main lighting surface, flat frame and LED carriers are placed onto the free marginal section of the luminaire member and are connected to it.

Embodiments of the invention will be explained with reference to the drawing.

DESCRIPTION OF THE PREFERRED EMBODIMENTS

Figure 1:
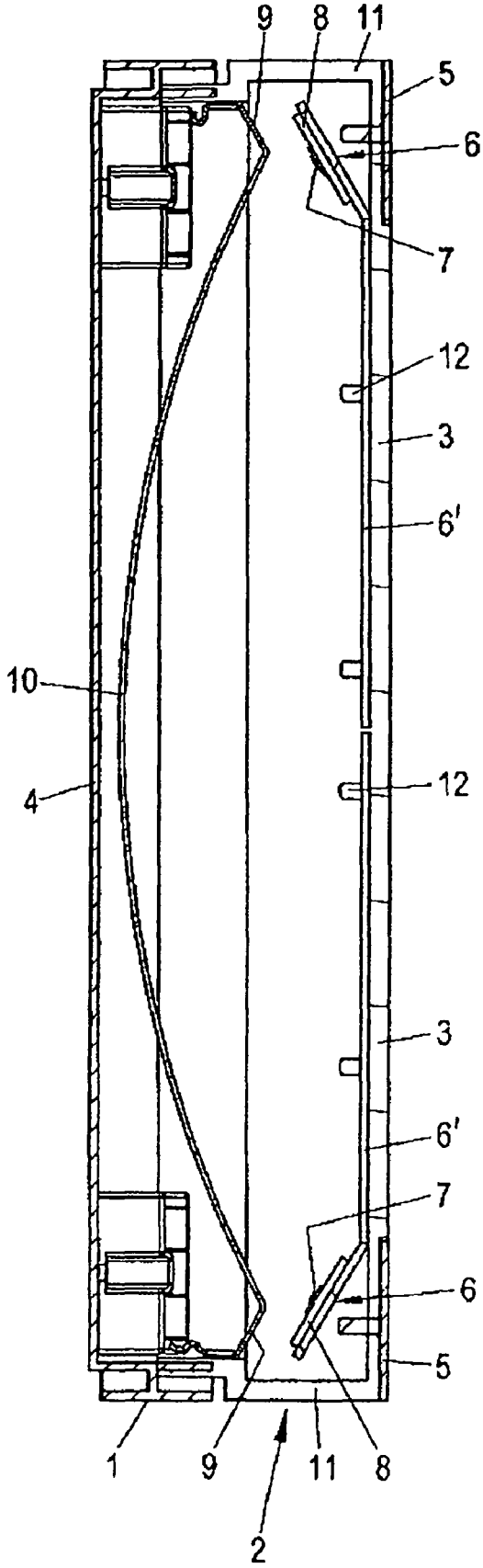
FIG. 1 is a schematic sectional view of an embodiment of the invention made in the manner of a luminaire member.

In accordance with FIG. 1, the luminaire includes a housing 1 of flat-pot shape and a functional unit 2 which can be coupled and connected to the housing 1 and which is formed by a shaped body of light permeable material.

The functional unit 2, together with the housing 1, defines a shallow inner space in which a reflector 10 is located which is concave with respect to the main lighting surface 3, which is mounted in the housing 1 and whose lowest point extends up to and into the proximity of the base wall 4 of the housing and has, in the region of its upper and its lower rim, a marginal region which is folded at an oblique angle in the direction of the housing and respectively forms a partial reflector surface 9.

The functional unit 2 made of light permeable material and having a planar main lighting surface 3 supports a peripheral flat frame 5 of light impermeable and in particular heat conducting material which bounds the main lighting surface 3, on the one hand, and terminates flush with the side wall of the functional unit 2, on the other hand.

An LED carrier 6 is provided in the inner space of the functional unit 2 and disposed beneath the flat frame 5 at the rear side and is made of heat conducting material and is connected via fixing rails 6', which are likewise heat conducting and which are preferably shaped in one part, and connection elements 12 passing through the light permeable material of the functional unit 2.

The fixing rails 6 connected at the side to the LED carrier 6 extend beneath the flat frame 5 while contacting the inner side of the main lighting surface 3 and are connected fixedly and in a heat conducting manner to the flat frame 5 via the spigot-shaped connection elements 12 provided at the inner side at the flat frame 5.

The LED carrier 6 can in particular be set in its inclination with respect to the main lighting surface 3 by a simple bending procedure relative to its fixing rails 6' so that the LEDs arranged on a surface 8 of the carrier 6 which is in particular made reflective can be directed ideally with respect to the concave reflector 10—while taking the optical system preferably associated with the LEDs into account—and the reflector is thereby illuminated by light uniformly at least from one side and preferably from both sides and the desired main lighting surface 3 is obtained which is backlit diffusely over the full area.

The LEDs whose monochromatic light color is presentable are preferably positioned such that some of the light output by them is also incident onto the part reflector surfaces 9 and is reflected from there to the side walls of the functional unit. Since these sidewalls are light permeable, side lighting surfaces 11 arise in this manner which are advantageously visible on a design as attached luminaires or semi-built-in luminaires.

Figure 2:
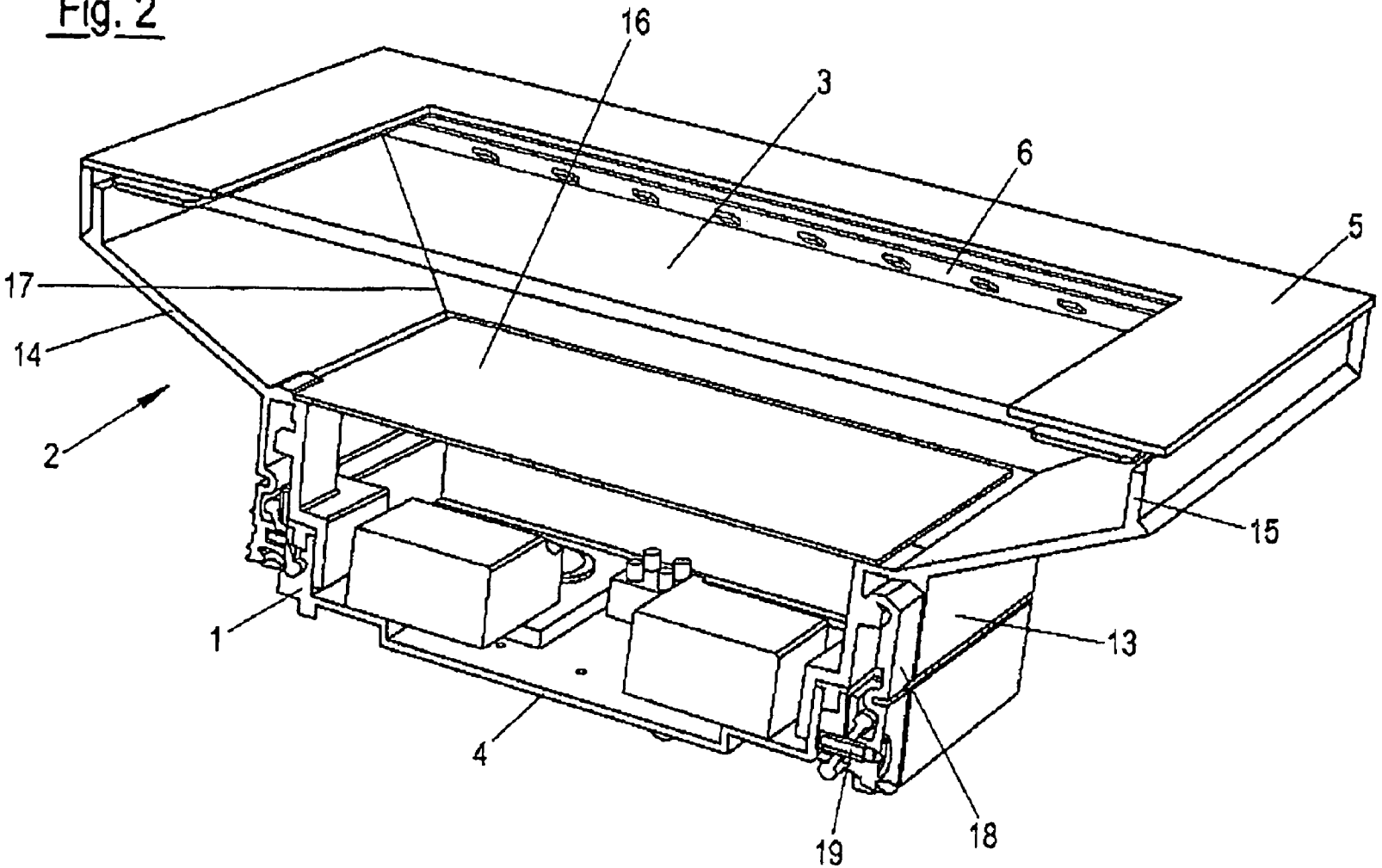
FIG. 2 is a perspective, sectional view of an embodiment of the invention designed in the manner of a flat screen.

FIG. 2 shows a preferred embodiment of the invention which is made in the manner of a flat screen with respect to its spatial design.

In this embodiment, the shallow pot-shaped housing 1 is couplable via snap-in clamping elements 18 integrated in a flat and flush manner to an expanding spatial body which is formed from a base section 13 and a slanted surface section 14 which adjoins it and expands at all sides and which merges into a marginal section 15 which is made as a carrier for the main lighting surface 3 and the flat frame 5. The snap-in clamping elements or clamping clips 18 can be blocked via a securing screw 19.

The arrangement of the light emitting diodes beneath the flat frame 5 and the removal of the heat generated by the LEDs to the flat frame 5 are designed in an analog manner to the embodiment of FIG. 1. Instead of a concavely curved reflector such as is provided in the embodiment of FIG. 1, in accordance with FIG. 2, a reflector 16 is used which is preferably made in planar manner, is arranged between the base section 13 and the slanted surface section 14 and simultaneously forms a dividing wall. The slanted surfaces 14 are as a rule light permeable, but their inner wall sides can also be made reflective and form a total reflector with the planar reflector 16, the total reflector reflecting the light radiated by the "LEDs" arranged in a hidden manner onto this total reflector in a diffuse manner toward the main lighting surface 13 and ensuring it is illuminated by reflection light in a largely uniform manner.

To ensure a light yield which is as high as possible, a plastic plate provided with a microprism structure is preferably used for the realization of the main lighting surface and is preferably covered by a glass plate at the prism side and by a light scattering film at the rear side. This structure is combined with the flat frame 5 to form a unit and is preferably adhesively bonded or welded to the marginal section 15.

To achieve that the region at the wall side disposed behind the installed luminaire is also illuminated by light on a frontal observation of the luminaire, provision is made in accordance with a preferred embodiment for at least the marginal section 15 extending perpendicular to the main lighting surface 3 to be made light permeable.

The units required for the power supply of the LEDs are located in the region beneath the planar reflector 16. The electrical connection between these power supply units and the LEDs preferably takes place via electrical conductors which are guided along the folding edges 17 between adjacent slanted surfaces. These electrical conductors do not appear in a visually irritating manner in this way.

Figure 3:
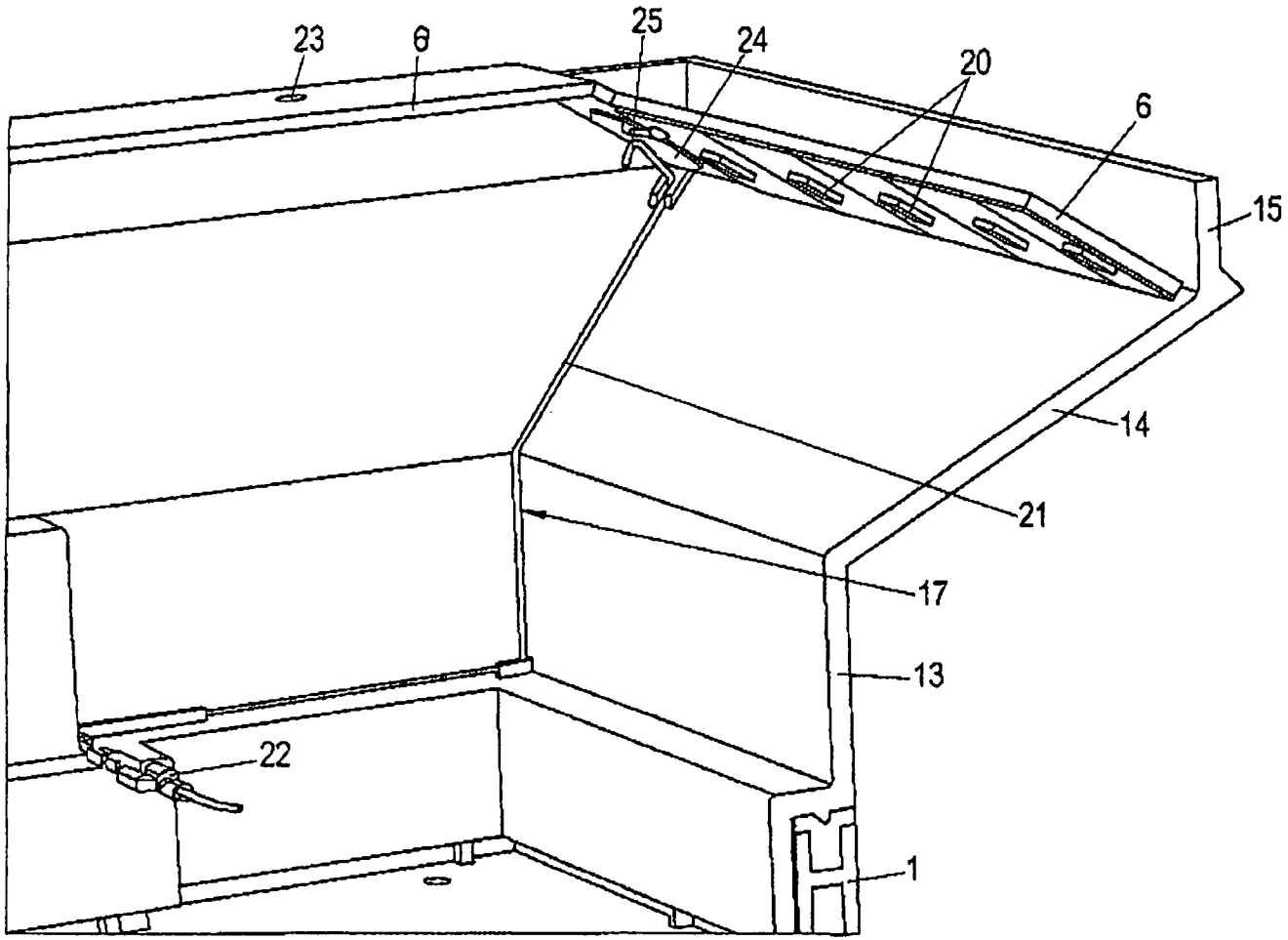
FIG. 3 is a perspective part representation of a usable electrical connection technology of the LED units.

FIG. 3 shows a part region of a luminaire in accordance with the invention for the explanation of the contacting of the LED units. In this representation, the reflector surface 16 dividing the upper region of the luminaire and the region of the luminaire at the housing side is not shown, but the support rims for this reflector surface at the step-shaped transition region between the base section 13 and the end section engaging into the housing 1 can be seen. The respective electrical conductor 21 which is connected to the power supply via a plug connection 22 extends in folding edges 17 and ends in a spring contact 25 in the region of the LED carrier 6. A contact surface 24, which the spring contact 25 contacts when the unit of main lighting surface 3, flat frame 5 and LED carrier 6, with associated fixing rails 6', is connected to the marginal section 15, is disposed opposite the spring contact 25 at the LED carrier 6.

The contact surface 24 is in electrical connection with the LEDs 20; i.e. each group of LEDs 20 is connected to the power supply via two contact surfaces 24.

The representation in accordance with FIG. 3 also still shows the embodiment of the lateral fixing rails 6' which are provided with bores 23 through which the connection elements 12 extend in the installed state which are provided at the flat frame 5. It can also be seen that the LED carrier 6 can be changed with respect to its angular position to the fixing rails 6' by a bending procedure, with the electrical contact between the spring contact 25 and the contact surface 24 being maintained unchanged.

Each of the two LED carriers 6 provided disposed opposite one another extends over the length of a rectangular side and each has a contact surface 24 at both ends. The two fixing rails 6' associated with each LED carrier 6 and extending perpendicular to the carrier 6 extend in each case up to the center of the respective rectangular side.

Figure 4:
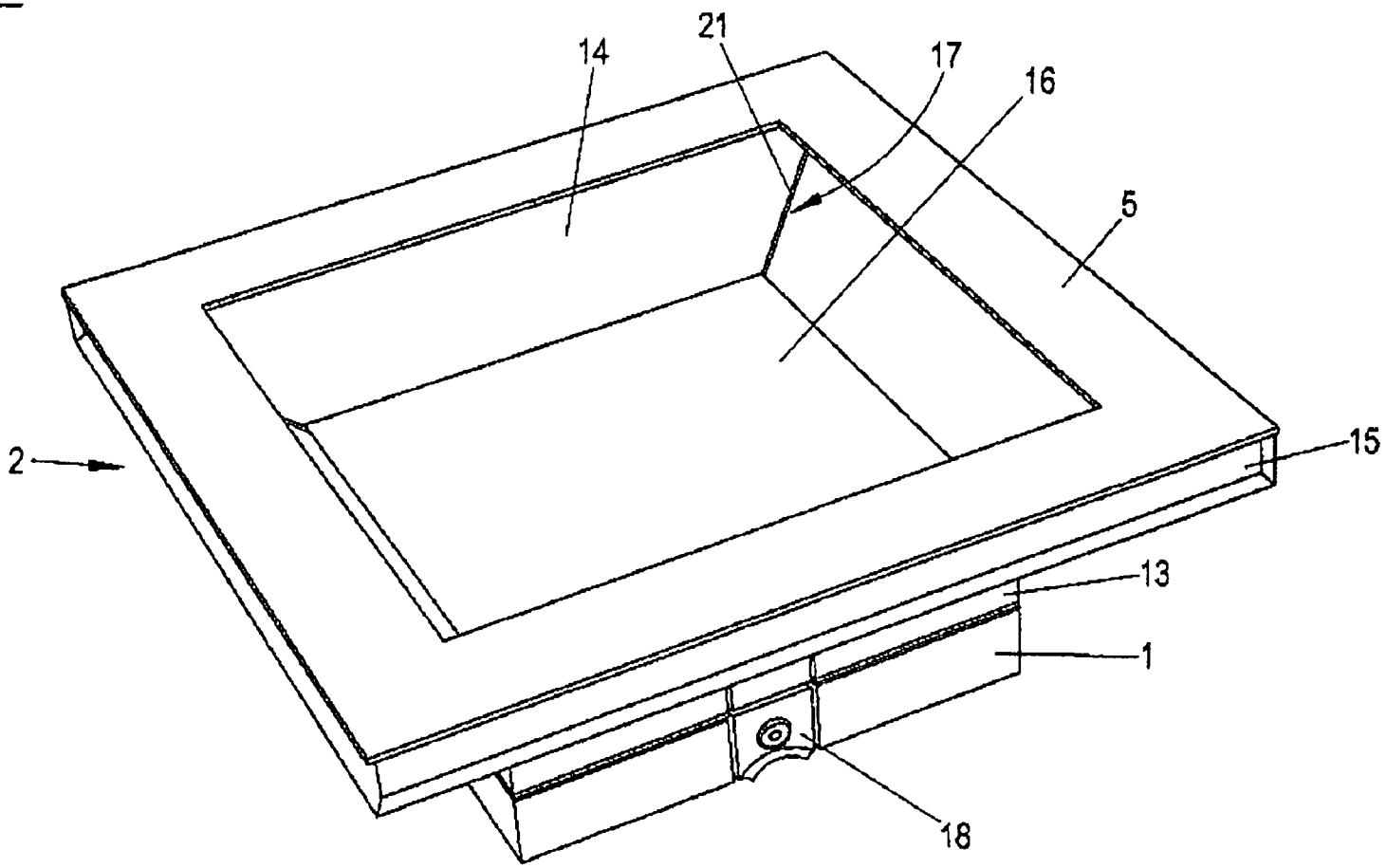
FIG. 4 is a perspective slanted view of an embodiment of the invention in a rectangular design.

The perspective representation in accordance with FIG. 4 shows a preferred embodiment of a luminaire in accordance with the invention having a rectangular structure or square structure. In this connection, the housing 1 is connected to the functional unit 2 via clamping clips 18 so that the functional unit 2 only has to be placed onto the housing 1 and coupled to the housing by means of the snap-on connections 18 after establishing the electrical connections in the region of the housing 1 including the plug connection 22 shown in FIG. 3.

FIG. 4 also makes clear that the LED units are practically not visible and also that the electrical conductors 21 leading to these units in the four folding edges 17 do not appear in an irritating manner. A full area and very uniform application to the main lighting surface is achieved via the large area reflector 16 and it can additionally also be ensured that the respective desired lateral light radiation takes place via the marginal sections 15, the slanted surface sections 14, which cannot be seen in this representation, and the base sections 13.

The main lighting surface 3 can bear pictograms or other marks such as house numbers, with these marks appearing particularly clearly due to the uniformly diffuse backlighting. This application possibility is an example for the variety of possible uses of the luminaire in accordance with the invention, in particular designed in the manner of a flat screen.

The invention claimed is:

1. A luminaire with a pot-shaped housing for the reception of electrical components and for the releasable mounting of a functional unit having at least one light permeable main lighting surface and light emitting diodes (LEDs), wherein the essentially planar main lighting surface of the functional unit extends parallel to the base wall of the housing or a mounting surface of the housing and the LEDs are directed to a reflector arranged between the base wall of the housing and the main lighting surface, wherein the main lighting surface is bounded at the rim side by a peripheral flat frame made of heat conducting material, and side lighting surfaces to which light is applied are provided between the flat frame and the housing in addition to the main lighting surface;

the LEDs are attached to at least one heat conducting carrier; and the flat frame is connected in a heat conducting manner to at least one LED carrier which is located in the functional unit in the region of the rear side of the flat frame and whose surface carrying the LEDs is directed toward the reflector such that the main lighting surface is illuminated substantially uniformly by diffuse light.

2. A luminaire in accordance with claim 1, wherein the flat frame forms both the outer boundary of the main lighting surface at the visible side and the functional unit.

3. A luminaire in accordance with claim 1, wherein the functional unit supporting the flat frame is made as a light permeable body, in particular as an opal glass body or as a single-part or multi-part plastic body.

4. A luminaire in accordance with claim 3, wherein the flat frame is inserted in an areally flush manner into a matching cut-out of the front wall of the functional unit.

5. A luminaire in accordance with claim 1, wherein the reflector provided between the base wall of the housing and the main lighting surface is concavely curved and a lowest region of the main lighting surface is disposed adjacent to the base of the housing.

6. A luminaire in accordance with claim 1, wherein, in addition to the main lighting surface, side lighting surfaces, which are illuminated via the reflector and optionally also directly, are provided between the flat frame and the housing.

7. A luminaire in accordance with claim 6, wherein part reflector surfaces are associated with the side lighting surfaces which are formed by angled marginal regions of the concavely curved reflector.

8. A luminaire in accordance with claim 1, wherein the LED carriers are connected to fixing rails or are made in one part which contact the wall of the functional unit beneath the flat frame and are connected to the flat frame and mounted via heat conducting connection elements passing through the wall of the functional unit.

9. A luminaire in accordance with claim 1, wherein the support surface for the LEDs is made reflective.

10. A luminaire in accordance with claim 1, wherein an optical lens system is associated with the LEDs, with either an individual lens being provided for each LED or an optical unit common to all LEDs being provided.

11. A luminaire in accordance with claim 1, wherein the angle between the surface carrying the LEDs and the fixing rails contacting the main lighting surface at the rear side can be adjusted.

12. A luminaire in accordance with claim 1, wherein the functional unit is made as a spatial body expanding at all sides starting from the housing of a flat pot shape or having a presettable spacing from the housing and has a base section couplable to the housing and an expanding slanted surface section which adjoins the base section and which merges into a marginal section which is made as a support for the main lighting surface and the flat frame.

13. A luminaire in accordance with claim 12, wherein the main lighting surface includes a plastic plate which is provided with a microprism structure and which is preferably covered with a glass plate at the prism side and with a light scattering foil at the rear side.

14. A luminaire in accordance with claim 13, wherein the substantially planar main lighting surface is combined with the flat frame to form a unit and is connected, in particular welded or adhesively bonded, via an angled peripheral wall to the marginal section of the spatial body.

15. A luminaire in accordance with claim 12, wherein a reflector, preferably a planar reflector, forming a dividing wall is arranged between the base section and the slanted surface section.

16. A luminaire in accordance with claim 15, wherein the inner walls of the slanted surface section are made reflective.

17. A luminaire in accordance with claim 12, wherein the functional unit is couplable via clamping clips to the housing.

18. A luminaire in accordance with claim 12, wherein the light emitting diodes positioned beneath the flat frame and illuminating the reflector are connected to the associated energy supply arranged in the region of the housing via conducting wires which extend in accordance with the folding edges between adjacent slanted wall part surfaces.

19. A luminaire in accordance with claim 18, wherein the conducting wires are electrically connected to the LEDs via a spring contact engaging at a contact surface at the LED carrier.

20. A luminaire in accordance with claim 1, wherein the housing, functional unit and flat frame have a polygonal structure, in particular a rectangular structure, or a round structure.

* * * * *